United States Patent [19]

Kleuters

[11] Patent Number: 4,474,253

[45] Date of Patent: Oct. 2, 1984

[54] APPARATUS FOR PRODUCING AN UPWARDLY DIRECTED DRILL HOLE

[75] Inventor: Nikolaus Kleuters, Geilenkirchen, Fed. Rep. of Germany

[73] Assignee: Wirth Maschinen-und Bohrgerate-Fabrik GmbH, Erkelenz, Fed. Rep. of Germany

[21] Appl. No.: 561,960

[22] Filed: Dec. 16, 1983

[30] Foreign Application Priority Data

Dec. 23, 1982 [DE] Fed. Rep. of Germany ..... 3247632

[51] Int. Cl.[3] ..... E21B 3/02

[52] U.S. Cl. ..... 175/94; 175/99; 173/64

[58] Field of Search ..... 299/31; 175/94, 97, 175/99, 162; 91/170 MP; 405/302; 173/72, 64, 65

[56] References Cited

U.S. PATENT DOCUMENTS 4,314,615 2/1982 Sodder, Jr. ..... 175/94

4,396,072 8/1983 Hurtz ..... 175/57

*Primary Examiner*—Ernest R. Purser

*Assistant Examiner*—Timothy David Hovis

*Attorney, Agent, or Firm*—Holman & Stern

[57] ABSTRACT

An apparatus for producing an upwardly directed drill hole with feed cylinders and a clamping cylinders contains a pressure medium system with a pump, a supply duct and a control valve. In order to attain a particularly favorable and simple design, a second pump is provided, for feeding a second supply duct, from which at least one branch duct containing a choke or the like leads to the drilling head or its tools. The control valve is provided between the first pump and the first supply duct for one set of sides of the clamping and feed cylinders.

6 Claims, 7 Drawing Figures

APPARATUS FOR PRODUCING AN UPWARDLY DIRECTED DRILL HOLE

BACKGROUND OF THE INVENTION

1. Field of the Invention

The invention relates to apparatus for producing an upwardly directed drill hole in rock, deposits, or the like by drilling from a roadway, starting chamber or the like, having a basic unit to be disposed in the starting chamber, a drilling head or the like, a rotary drive for the drilling head, a train of rods—which may be assembled from a plurality of parts13 between the basic unit and a supporting body with a bearing housing for the drilling head, a slide which is axially displaceable relative to the supporting body and a clamping apparatus which is associated with the latter and which comprises clamping cylinders in which pistons connected to plates which may be applied to the wall of the drill hole may be displaced outwards by pressure medium and inwards by springs and/or pressure medium, and having feed cylinders interposed between the supporting body or the drilling head bearing housing on the one hand and the slide or parts disposed thereon on the other and containing pistons which may be acted upon at both ends by pressure medium, there being provided, in order to actuate the feed cylinders and the clamping apparatus, a pressure medium system which contains at least one common supply duct—which is to be fed by a pump on the basic unit and is guided through the train of drill rods or is formed thereby—for one set of sides of the clamping cylinders and one set of sides of the feed cylinders and contains a reversing valve, by means of which cylinder spaces of the feed cylinders may be optionally connected to the supply duct or may be released from pressure.

2. Description of the Prior Art

In a known apparatus of this type (German Patent No. 30 11 449), in order to actuate the feed cylinders and the clamping apparatus there is provided a common supply duct which divides into a branch leading to the feed cylinders and a branch leading to the clamping apparatus. Only downstream of the branching is a reversing valve provided in the guide path to the feed cylinders. The annular spaces of the feed cylinders or the full spaces thereof may be connected by means of the reversing valve to the supply duct, while the respective other spaces may be opened to an outlet. A counter pressure valve and parallel thereto a non-return valve with a reverse flow direction are provided in the branch of the entire supply line leading to the cylinders of the clamping apparatus.

The aforesaid reversing valve is actuated with pressure medium by a control pump, the drive of which is derived from the rotary drive movement of the drilling head. The control pump, the reversing valve and further accessory elements are disposed on the supporting body positioned in the drill hole during operation or on a part connected thereto.

BRIEF SUMMARY OF THE INVENTION

It is an object of the present invention to design an apparatus of the type described above in an advantageous manner. In particular, the part of the apparatus situated in the drill hole during operation should as far as possible be kept free of complicated hydraulic control elements, pumps or the like. In this case the invention aims for a simple design of the pressure medium system for the feed cylinders and the clamping apparatus.

According to the invention, in addition to a first pump, in particular a high pressure pump, there is provided a second pump, in particular a low pressure pump, which is associated with the basic unit and the feed duct of which is to be connected to a second supply duct guided through the train of drill rods or formed thereby and connected to the other sides of the feed cylinders. At least one duct, in which a feed duct of which is to be connected to a second supply duct guided through the train of drill rods or formed thereby and connected to the other sides of the feed cylinders. At least one duct, in which a counter-pressure valve, a choke or the like is disposed, leads from the second supply duct to the drilling head or its tools. The reversing valve is provided between the feed duct of the first pump and the first branching supply duct for one set of sides of the clamping and feed cylinders in such a way that the said cylinder sides may simultaneously either be connected to the first supply duct or be opened to the outlet.

Thus, in general terms, the invention provides apparatus for producing an upwardly directed drill hole, comprising a basic unit to be disposed below the hole to be drilled, a drilling head, a rotary drive for the drilling head, a supporting body with a bearing housing for the drilling head, a train of drilling rods consisting of a plurality of interconnectable parts—between the basic unit and the supporting body, a slide which is axially displaceable relative to the supporting body, a clamping apparatus associated with the slide and comprising fluid pressure operated piston and cylinder clamping to the wall of the drill hole, double-acting fluid pressure operated piston and cylinder feed means interposed between the bearing housing and the slide to displace the said members with respect to each other, a fluid pressure medium system, a first fluid pressure source on the unit, at least one common first supply duct fed by the first fluid pressure source and extending through the train of drill rods—for one set of sides of the cylinders of the clamping means and one set of sides of the cylinders of the feed means, and a control valve by means of which cylinder spaces of the feed cylinders may be selectively connected to the first fluid pressure source and released from pressure, respectively, the apparatus further comprising:

(a) a second fluid pressure source on the basic unit and a second supply duct fed by the second source, the second supply duct extending through the train of drill rods and being connected to the other sides of the cylinders of the feed means; and (b) at least one branch duct containing counter-pressure means and leading from the second supply duct to the drilling head;

(c) the said control valve being situated between the first fluid pressure source and the first supply duct for the said one set of sides of the cylinders of the clamping and feed means in such a way that the said cylinder sides may simultaneously either be connected to the first fluid pressure source or be released from pressure.

Such apparatus is characterized by a number of considerable advantages. A special hydraulic system with control or operating elements on the part situated in the drill hole during operation is not necessary. The operational reliability of the system is thus further improved. The operation of the apparatus is simple since, in order to be able to perform the various procedures reliably, switching on pumps or other fluid pressure sources and actuation of valves is only necessary at the operating platform. There is conscious control of the operations, in particular during the adding procedure or resetting. Where a manometer or other pressure meter is provided at the operating platform, the pressure coming into effect in the drill hole and hence the force may be read off in each case, without there being uncertainties as to what is actually happening in the part of the apparatus situated in the drill hole. Since elements previously required on this part of the apparatus are dispensed with, there is furthermore a further advantage is terms of space as the passages for the drilled material loosened by the drilling head may now be kept larger.

At least one non-return valve is advantageously provided in the second supply line. This is beneficial for the mode of operation.

In a further development of the apparatus a second control valve is interposed between the second fluid pressure source and the second supply duct, and a connecting duct with a non-return valve is provided between an outlet of the second control valve and the first fluid pressure source. This allows additional operating procedures in an advantageous manner.

A blocking or shut-off means, which can be operated to prevent the clamping cylinders from being acted upon, may be provided in a branch of the first supply duct leading to one set of sides of the clamping cylinders, if this is desired or required in specific procedures, for example at the beginning of a drilling procedure, if the clamping means is not yet in the drill hole.

Water or a liquid containing water may be used, in particular, as the pressure medium for feeding the first supply duct. In this connection, oil may be provided as the pressure medium or another medium which has a lower specific gravity than water in the upper part of the pressure medium system, namely in the region containing the cylinder spaces of the feed cylinders and the clamping cylinders and, where appropriate, part of the ducts leading thereto. This offers the advantage that an account of the oil the cylinder spaces and pistons in question are not subject to any risk of corrosion, and the pump need hold less weight. Since the oil always rises with respect to the water on account of its lower specific gravity, a quantity of liquid is involved which is only moved to and fro, but does not reach the pump.

BRIEF DESCRIPTION OF THE DRAWINGS

The invention will be described further, by way of example, with reference to the accompanying drawing, inwhich.

DETAILED DESCRIPTION

Figure 1:
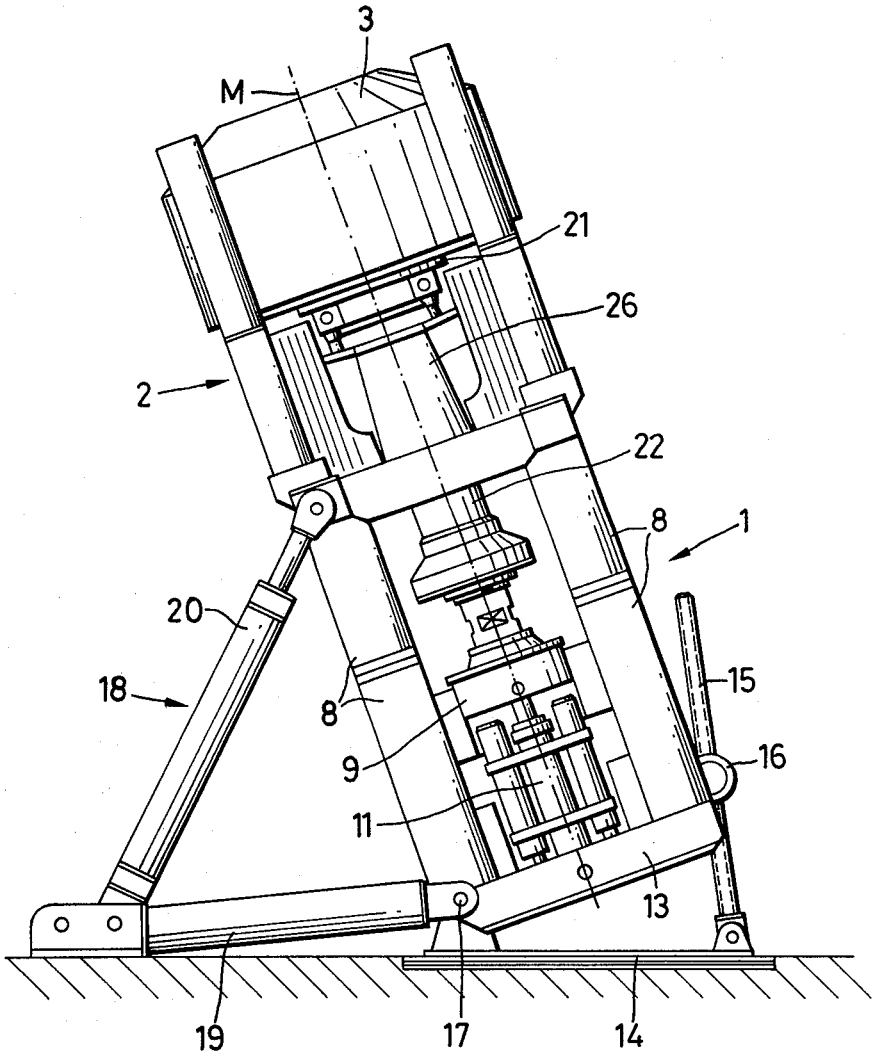
FIG. 1 is an elevation of an embodiment of the apparatus according to the invention in an assembled position.
Figure 2:
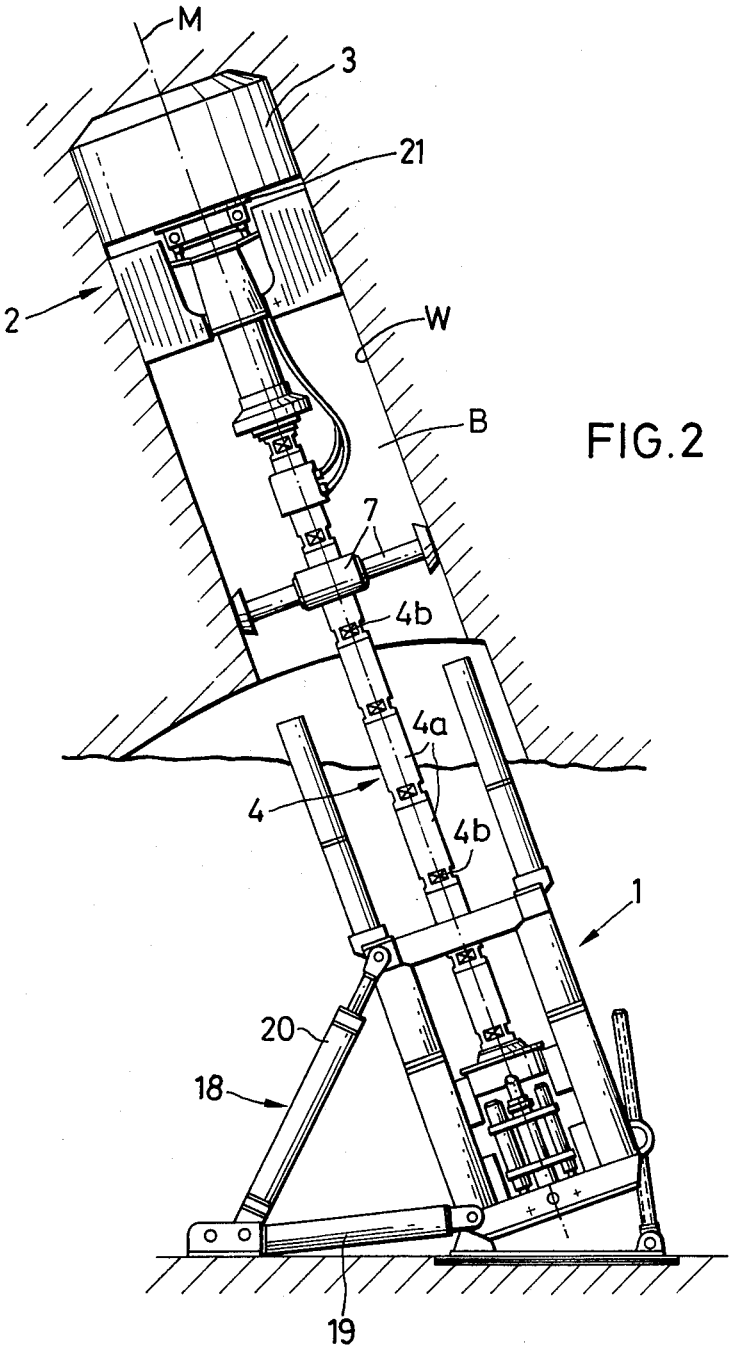
FIG. 2 shows the apparatus according to FIG. 1 in an operating position.

The apparatus illustrated comprises a basic unit 1 which may be erected underground in a roadway, a starting chamber or the like, a driving part 2 forming the drill hole B and comprising a drilling head 3, and a train of drill rods 4 connecting the driving part 2 to the basic unit 1. The train of rods 4 consists of individual rod portions 4*a* (FIG. 2), in particular tubes, which are screwed together by means of screw threads at their ends similarly to the case of a deep-drilling train of rods or may be releasably attached in another way. Inside the train of rods 4 two conveying ducts or paths for pressure medium are provided or are formed by the train of rods, e.g. in the form of a double-walled train of rods. The pressure medium is used for supplying elements of the driving part 2 and is introduced into the train of rods 4 in a manner known per se by way of a rotary guide means provided in the basic unit 1. It is delivered by pressure medium sources (not shown in FIGS. 1 and 2) and is conveyed by way of hoses or the like. Other operating units and power supply units are not specially illustrated in FIGS. 1 and 2. They may, together with an operating platform, be assembled beside or in the vicinity of the basic unit 1 in the starting chamber. The ends of the rod portions 4*a* are each provided with square surfaces 4*b* (FIG. 2) which are engaged by members, fitted in the head part 6 of the basic unit 1, of an apparatus operating in accordance with a known principle and serving to catch, break and add or dismantle individual rod portions, when the train of rods 4 is to be extended, depending upon the drilling progress made, or is to be dismantled at the end of the drilling work. Depending upon the requirements, one or more rod portions 4*a* may be equipped with a stabilizer 7 which comprises a rotary bearing and supporting arms or the like, as indicated in FIG. 2.

The basic unit 1, which is in the form of a frame structure for example, comprises a lifting slide 9, which is guided on columns 8 and on which are arranged two or four drive motors, in particular hydraulic motors, the speed of which is preferably variable and the rotational direction of which is, where appropriate, reversible. The drive motors transmit their torque by way of gearwheels for example to a central driving part which receives the lower end of the train of rods 4 with positive locking or comprises or forms a coupling member for the lowest rod portion in each case in such a way that the train of rods 4 may be driven by the motors so as to rotate at the values desired in each case.

Two supporting cylinders 11 are associated with the lifting slide 9, the piston rods 12*a* of the pistons 12, which are slidable in the said supporting cylinders 11 and which may be acted upon at both ends by pressure medium by way of ducts (not shown in FIGS. 1 and 2), engaging on the lifting slide 9, while the cylinders 11 are articulated on lower frame parts 13 of the basic unit. In this way, by means of the said supporting cylinders 11, the lifting slide 9 and hence the train of rods 4 extending upwards therefrom may—during drilling, while rod portions are being added, while the train of rods is being dismantled, and in other cases—be moved up and down or be loaded with a desired force in one or other direction or even be held stationary.

The basic unit 1 may be assembled vertically or at an angle to the vertical. The latter case is shown in FIGS. 1 and 2, it being possible to set and maintain the oblique position by threaded spindles 15 which engage on a base plate 14 in an articulated manner and into which engage nuts 16 mounted on lower frame parts 13 in an articulated manner. The numeral 17 designates a shaft or a pivot bearing about which the basic unit or the entire apparatus may be swung. An erector device 18, which may be articulated on the shaft 17 of the basic unit by way of an arm 19 and which comprises one or more erecting cylinders 20, may be used as an auxiliary means for erecting the apparatus.

The drilling head 3 of the driving part 2 may be formed in a manner corresponding to the respective case of application and may be provided with suitable tools, in particular with roller bits, disc or wart rollers or the like. A projecting part or an extension with a tool for producing a smaller leading drill hole may be provided on the drilling head or in addition thereto. A bearing housing 21 contains the rotary bearing of the drilling head 3 and which therefore does not itself rotate. Rigidly attached to the bearing housing 21 is a supporting body 22 (cf. FIGS. 3 and 4 in particular) which externally is shaped as a polygon, e.g. a square, and through the interior of which passes a tube or hollow shaft 24 which forms a continuation of the train of rods 4 and which is connected to the drilling head 3 and, at its lower end, comprises a tapered threaded portion 23 for screw connexion to an adjoining threaded portion 4*a* shaped accordingly. The supporting body 22 ends in a housing 25 which may contain a rotary guide means for pressure and parts belonging to a pressure medium system.

A slide 26, the housing 27 of which surrounds the polygonal portion of the supporting body 22 and matches its shape, is displaceable on the supporting body 22. Two feed cylinders 28 are arranged in pairs on both sides of the median axis M of the apparatus in each case and their lower ends are articualted on attachments of clamping plates 41, while the upper ends of the piston rods 29*a* of the pistons 29 slidable therein are articulated on parts of the bearing housing 21. A pressure medium duct 31 (indicated only diagrammatically and partially in FIGS. 3 and 4 in each case) leads to the annular spaces 28R of the feed cylinders 28.

In addition, the slide 26 is provided with a clamping device 40 which comprises for example four plates 41 which may be pressed against the wall W of the drill hole and which may be withdrawn therefrom. Each plate 41 has associated with it, for example, two clamping cylinders 42 with pistons 43, the piston rods 43*a* of which carry the clamping plates 41. Compression springs (not shown) are arranged inside or outside the cylinders 42 in such a way that they urge the clamping plates 41 radially inwards. The full surfaces of the pistons 43 may be acted upon with pressure medium by way of ducts 45 (shown only partially in FIGS. 3 and 4) in order to move the clamping plates 41 outwards against the force of the aforesaid springs. In the clamped state the device 40 forms, together with the slide 26, a counterabutment for the feed cylinders 28.

Figure 3:
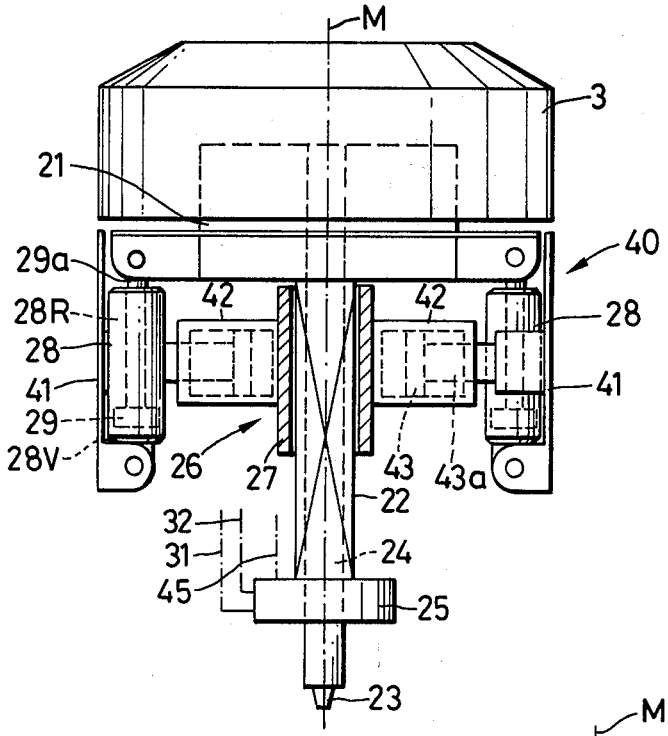
FIGS. 3 and 4 show the part of the apparatus operating in the drill hole, partly diagrammatically and partly in section, in two different positions of the feed apparatus.
Figure 4:
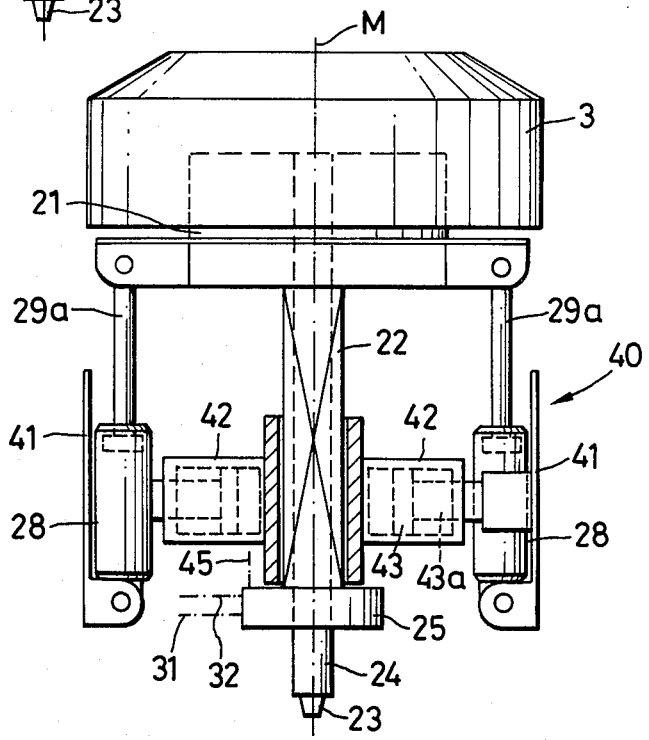

The arrangement is such that the slide 26 and the supporting body 22 may be moved, relative to one another, from the position according to FIG. 3 into that according to FIG.4, which, in particular when the plates 41 are pressed against the wall W of the drill hole, corresponds to a drilling stroke with an advancing force, while the movement out of the position according to FIG. 4 into that according to FIG. 3 allows the clamping apparatus to be recovered with the drilling head 3 remaining in its position and the clamping plates 41 released.

The pressure medium system contains a first pump 33 in the form of a high-pressure pump, which may be driven by a motor 34, e.g. an hydraulic motor, and which delivers water from a tank 35 into a feed duct 30 provided with a non-return valve 37. The desired water pressure may be set on a valve 36 which at the same time forms a safety valve for the pump 33. The feed duct 30 leads to a reversing valve 50 in the form of a directional control valve, from which an outlet 38 leads to the tank 35 and the other side of which is connected to a first supply duct 61. A manometer 39 is connected to the latter. The supply duct 61 continues in the train of drilling rods 4 by way of the aforesaid rotary guide means disposed in the basic unit as far as a rotary guide means in the housing 25 of the supporting body 22. Downstream of this the supply duct 61 divides and leads by one branch 62 to the respective full spaces 28V of the feed cylinders 28, while the other branch 63 leads to the ducts 45 and to the full spaces 42V of the clamping cylinders 42 of the clamping device 40. A blocking or shut-off valve 5 is provided in the branch 63.

A non-return valve (not shown) is advantageously provided in each rod portion 4*a* in the path of the first supply duct 61 in such a way that it closes when one rod portion is separated from the other, but is forcibly opened when the rod portions are assembled, so that with the rod portions assembled the supply duct 61 has a free passage in both directions. An air separator 51 or the like may be connected to the first supply duct 61.

In addition, the pressure medium system contains a second pump in the form of a low-pressure pump 65 which may be driven by a motor 64 and which conveys water from the tank 35 into a feed duct 66, to which a manometer 67 is connected and which leads to a second reversing valve 71 which continues by way of the aforesaid lower rotary guide means in the trains of rods 4 and leads from the upper rotary guide means in the housing 25 on the one hand as a duct 72 to the annular spaces 28R of the feed cylinders 28, while a second branch 73 represents a duct which leads as far as the drilling head 3 and in which is disposed counterpressure means such as a counterpressure valve which may be set to a specific value or a choke 74. Downstream of this the duct 73 opens out at the end 73*a* in such a way that the water emerging from it reaches the tools of the drilling head, in order to cool the said tools and, in addition, to wash away the loosened drilled material.

Non-return valves 75, which prevent the duct portions at the top in each from running idle, are provided in the region of the train of drilling rods at one or more places, preferably in each rod portion 4*a*.

A further outlet leads from the second reversing valve 68, by way of a connecting duct 70 provided with a non-return valve 69, to the feed duct 30 of the first pump 33.

The two pumps 33 and 65, the two reversing valves 50 and 68 and the associated parts are disposed on the basic unit 1 or on an operating platform associated therewith respectively.

Figure 5:
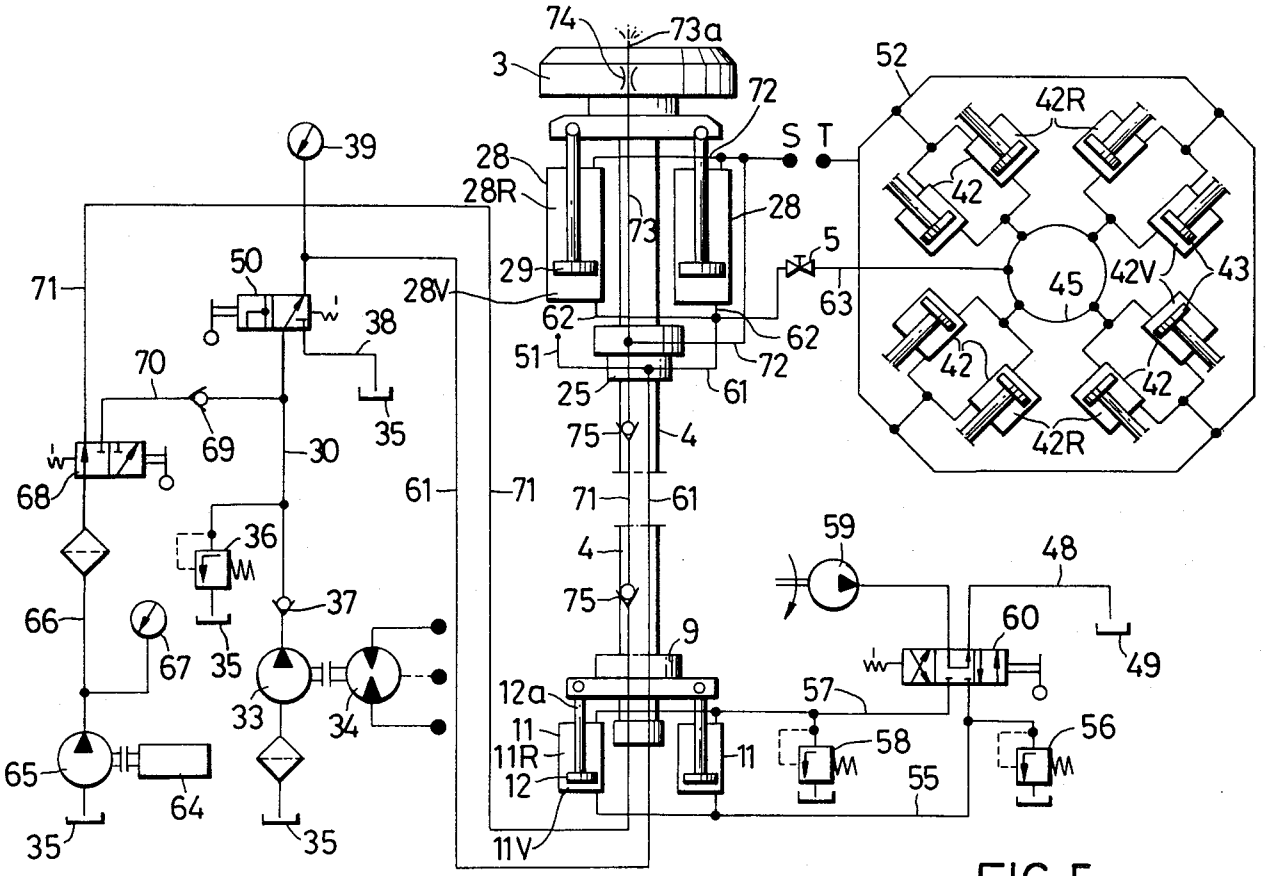
FIGS. 5 to 7 are pressure medium circuit diagrams illustrating different operating procedures.
Figure 6:
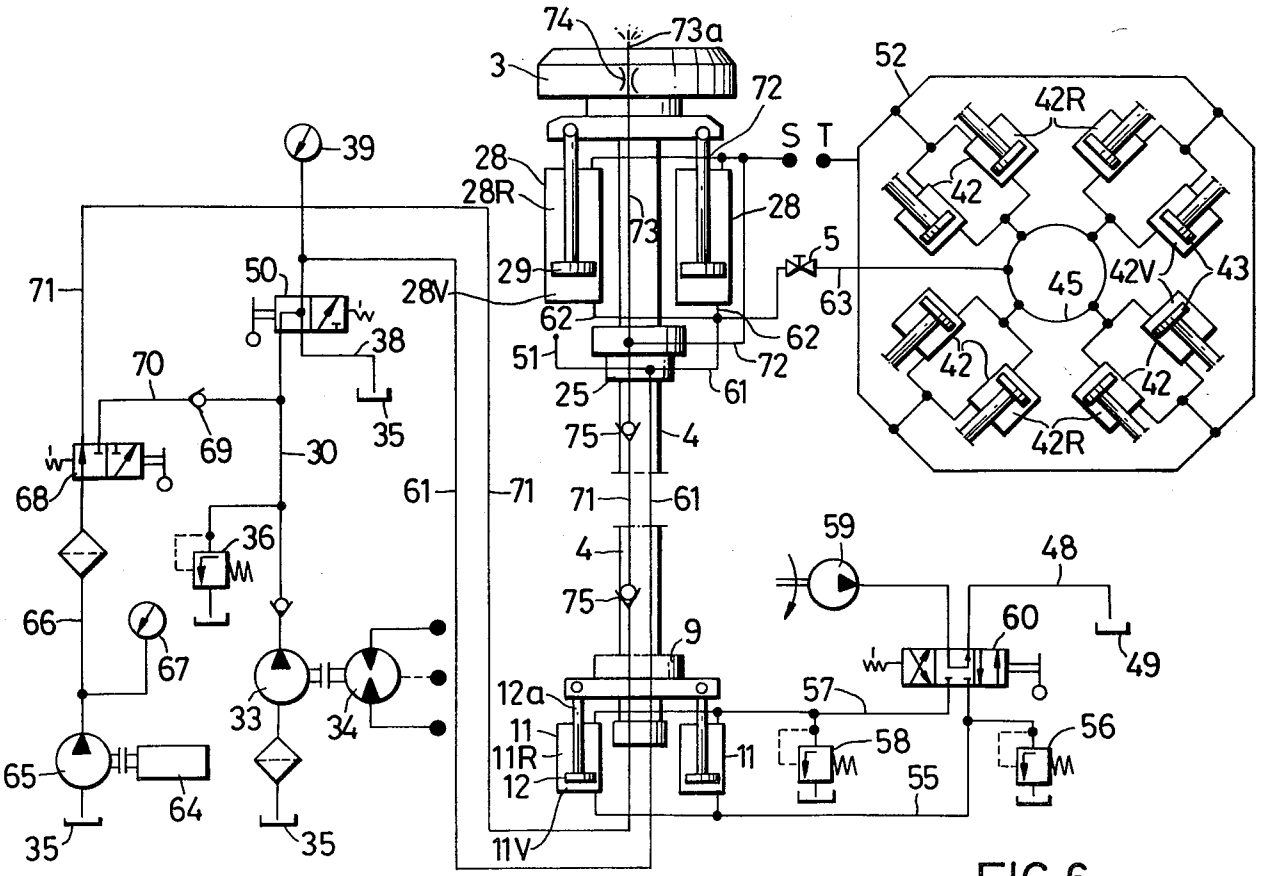
Figure 7:
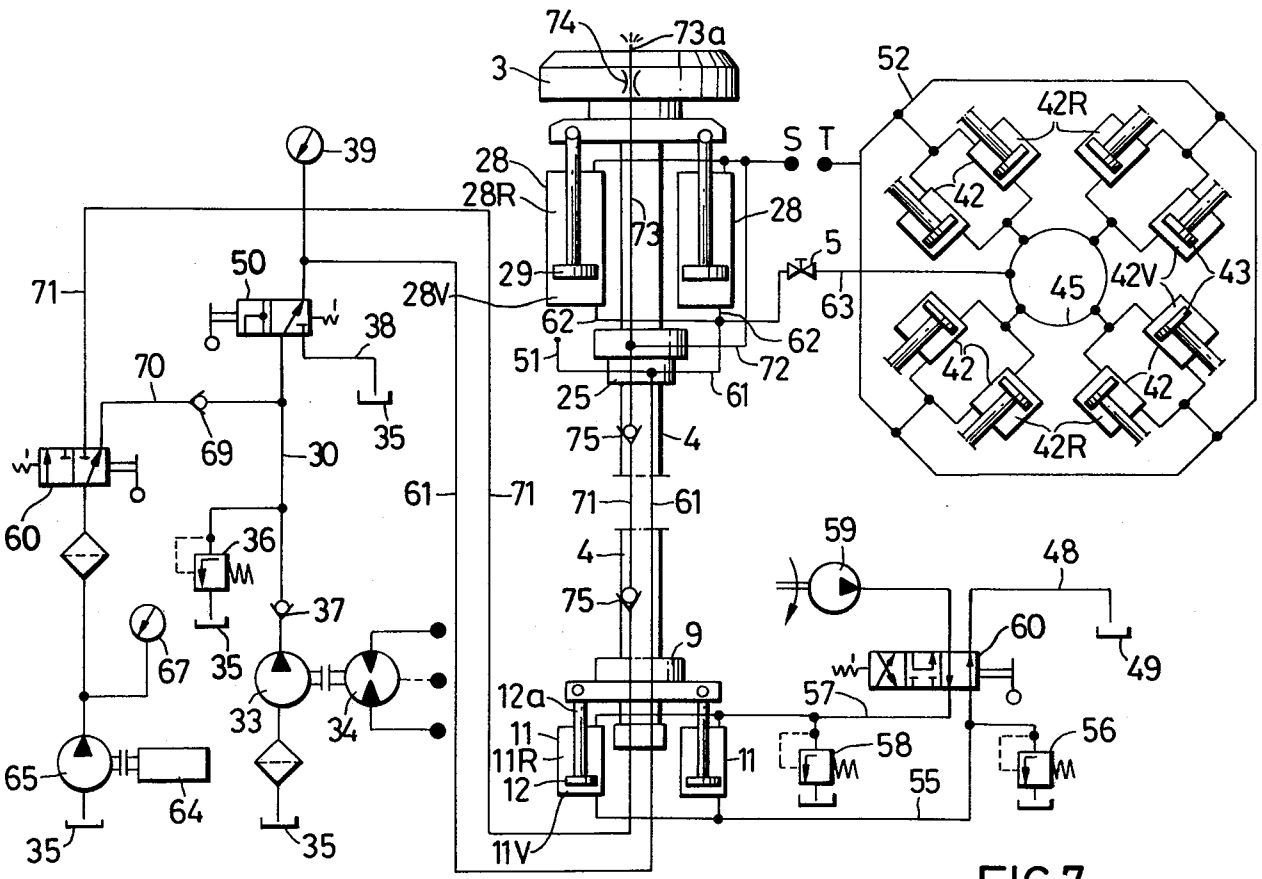

In the clamping device 40 only the full spaces 42V of the clamping cylinders 42 need in themselves be acted upon with pressure medium, since the pistons 43 or parts connected thereto are loaded in the opposite direction by springs, as described above. It is also possible, however, additionally to provide a pressure medium biassing for the annular spaces 42R of the clamping cylinders 42, if this is desirable or required. To this end a duct system 52, which may be connected to the branch 72 of the second supply duct 71 by way of a connection to be produced between the points S and T, is indicated in FIGS. 5 to 7.

The supply and control of the support cylinders 11 disposed in the basic unit 1 may be effected in various ways. An advantageous and simple embodiment of this is also shown in FIGS. 5 to 7. The system illustrated comprises a duct 57, leading to the annular spaces 11R of the supporting cylinders 11, together with a pressure-adjustment valve 58 in an outgoing branch and a duct 55 leading to the full spaces 11V of the supporting cylinders 11, likewise together with a pressure-adjustment valve 56 in an outgoing branch. The numeral 60 designates a reversing valve in the form of a 4/3-way valve to be actuated by hand, by remote control, automatically or in the framework of a program, and the numeral 48 designates a discharge duct. A pump 59 and a tank 49 for hydraulic oil or the like also belong to the system.

The operation of the apparatus with the pressure medium system described is explained below.

First of all the slide 26 together with the clamping device 40 is moved or brought back to a starting position. This is effected by switching on the second pump 65. The second reversing valve 68 is in the position indicated in FIGS. 5 and 6. It is assumed that the slide 26 together with the clamping device 40 is now in or has been brought back to a starting position, and clamping and then drilling are to be carried out. The second pump 65 remains switched on. The first pump 33 is switched on, while the first reversing valve 50 is in the position shown in FIG. 5. Water is thus conveyed into the first supply duct 61 through the train of rods 4 simultaneously to the full spaces 28V of the feed cylinders 28 and the full spaces 42V of the clamping cylinders 42. Since the pressure—produced by the second pump 65 and the choke 74—upon the annular surface 28R of the feed cylinders 28 opposes a resistance to the volume flow of the first pump 33, the pressure medium is first forcibly conveyed into the full spaces 42V of the clamping cylinders 42. In this way the clamping plates 41 are pressed against the wall W of the drill hole. As soon as the first pump 33 has overcome the resistance of the second pump 65 and the choke 74, the drilling head 3 can begin to operate, it being forced forwards by the feed cylinders 28. The directly inderdependent feeding and clamping force may be selected or matched according to circumstances by varying the pressure of the pressure medium conveyed in the system, in particular by setting the valve 36, it being possible to read off the pressure at the operating platform on a manometer 39.

Since the reversing valve 60 has previously been brought into the position in which the lower cylinder spaces 11V are supplied with pressure medium, the pistons 12 of these cylinders acting upon the lifting slide 9 follow the feed movement, it being possible to set the pressure to the desired value by means of the valve 56, in particular so that, even during this movement, a certain proportion of the weight of the train of rods 4 and the parts moving therewith in the drill hole is carried by the supporting cylinders 11, e.g. a proportion of $\frac{2}{3}$, while the remaining portion together with the feeding force itself is applied by the feed cylinders 28. In this way, by adjusting the pressures in the upper and lower system or by setting the respective valves, all the cases of need may be taken into consideration in an optimum manner.

If, in exceptional circumstances, the drilling head did not firmly abut the working face at the beginning of drilling, the ascent described above will only take place, and the clamping device 40 will only come into operation, with a certain delay. If desired, the supporting body 22, together with the train of rods 4, may be temporarily prevented from performing a forward movement of the reversing valve 60 initially remaining in the central blocking position or being brought thereto, until the biassing of the pistons of the supporting cylinders 11 is initiated at the given time by reversing the valve 60. By influencing the mode of operation of the supporting cylinders 11 by means of the hydraulic elements indicated or by means of other or additional control members, it is possible to produce, even during the drilling process, conditions which are particularly favourable therefor.

In the feed movement water displaced from the annular spaces 28R of the feed cylinders 28 is pressed through the ducts 72 and 73 and is discharged at the end **73*a*** on the drilling head tools.

During the drilling procedure the second pump 65 is also advantageously switched on, and in the position of the reversing valve 68 shown in FIG. 5 conveys water into the second supply duct 71 and the water is then discharged together with the displaced water from the feed cylinders 28 on the drilling head 3.

At the end of the drilling stroke the first pump 33 is switched off, a static pressure remaining in the system on account of the non-return valve 37, the drilling head drive is switched off and the reversing valve 50 is brought into the position shown in FIG. 6. In this way an immediate complete drop in pressure takes place, so that the clamping plates 41 are pressed or drawn inwards by the force of the aforesaid springs and are released from the wall W of the drill hole. The machine present in the drill hole is then supported on the train of rods held by the supporting cylinders 11.

The position of the reversing valve 60 belonging to the system of the supporting cylinders 11 may be as shown in FIG. 6. It is also possible, however, when the first pump 33 is switched off and the rotary drive for the drilling head is discontinued, for the supporting cylinders 11 to be additionally acted upon in such a way, for example by switching the valve 60 into the blocking position while the effectiveness of the valve 56 remains, that the discontinuation of clamping action is further accelerated.

The second pump 65 continues after the end of the drilling stroke. The second reversing valve 68 likewise remains in its previous position. Water is thus conveyed to the annular spaces 28R of the feed cylinders 28 by way of the second supply duct 71, so that the slide 26 together with the clamping apparatus 40 moves back upwards relative to the supporting body 22 and in this way is brought into a new starting position (cf. FIG. 3). In order to have an adequate pressure for restoring the slide 26, the choke 74 or a suitable counter pressure valve is dimensioned or adjusted in the manner required.

The train of rods 4 may be supported by suitably acting upon the supporting cylinders 11 or by the apparatus disposed in the head part 6 of the basic unit 1, whereupon the supporting cylinders 11 are lowered together with the lifting slide 9 and a new rod portion **4*a* is installed. After this or overlapping it in time, the slide 26** can again be clamped in the drill hole and then the drilling procedure can continue in the manner described.

At the end of the recovery of the slide 26 and after switching the first valve 50 into the position according to FIG. 5 the first pump 33 is switched on again, so that water is conveyed to the full spaces 42V of the clamping cylinders 42 and in this way the pistons 43 together with the clamping plates 41 are moved outwards and clamping takes place. The pressure which then builds up comes into effect in the full spaces 28V of the feed cylinders 28, so that a new drilling procedure can begin.

The system is, furthermore, designed in such a way that the clamping procedure or filling of the cylinder spaces in the clamping cylinders and, where appropriate, the feed cylinders may be rapidly effected. For this purpose, when the first pump 33 is switched off, the second reversing valve 68 is brought into the position shown in FIG. 7 and the second pump 65 is switched on. Water conveyed by the latter then flows back from the reversing valve 68 by way of the connecting duct 70, the first reversing valve 50 and the first feed duct 61 to the cylinder spaces connected thereto.

In such a procedure the reversing valve 60 in the system of the supporting cylinders 11 may be brought into the position shown in FIG. 7, so that the pistons 12 of the supporting cylinders 11 are acted upon in the sense of an upward movement and in this way the lifting slide 9, together with the train rods 4 and the parts carried thereby, is forced upwards. This may be advantageous inter alia when the drilling head has assumed a position in which it does not bear directly against the working face.

Furthermore, work may be carried out with the system associated with the supporting cylinders 11 in any operating condition of the apparatus, as required by the conditions in question. For this the system offers widely ranging possibilities.

All the features mentioned in the above description and illustrated in the drawing should, as far as the known state of the art permits, be regarded, either individually or in combination, as falling within the scope of the invention.

I claim:

1. Apparatus for producing an upwardly directed drill hole, comprising a basic unit to be disposed below the hole to be drilled, a drilling head, a rotary drive for the drilling head, a supporting body with a bearing housing for the drilling head, a train of drilling rods consisting of a plurality of interconnectable parts—between the basic unit and the supporting body, a slide which is axially displaceable relative to the supporting body, a clamping apparatus associated with the slide and comprising fluid pressure operated piston and cylinder clamping to the wall of the drill hole, double-acting fluid pressure operated piston and cylinder feed means interposed between the bearing housing and the slide to displace the said members with respect to each other, a fluid pressure medium system, a first fluid pressure source on the unit, at least one common first supply duct fed by the first fluid pressure source and extending through the train of drillrods, for one set of sides of the cylinders of the clamping means and one set of sides of the cylinders of the feed means, and a control valve by means of which cylinder spaces of the feed cylinders may be selectively connected to the first fluid pressure source and released from pressure, respectively, the apparatus further comprising:

(a) a second fluid pressure source on the basic unit and a second supply duct fed by the second source, the second supply duct extending through the train of drill rods and being connected to the other sides of the cylinders of the feed means; and (b) at least one branch duct containing counter-pressure means and leading from the second supply duct to the drilling head;

(c) the said control valve being situated between the first fluid pressure source and the first supply duct for the said one set of sides of the cylinders of the clamping and feed means in such a way that the said cylinder sides may simultaneously either be connected to the first fluid pressure source or be released from pressure.

2. Apparatus as claimed in claim 1, further comprising a second control valve interposed between the second fluid pressure source and the second supply duct, and a connecting duct with a non-return valve interposed between an outlet of the second control valve and the first fluid pressure source.

3. Apparatus as claimed in claim 1, further comprising at least one non-return valve in the second supply duct.

4. Apparatus as claimed in claim 1, further comprising blocking means in a branch of the first supply duct leading to the said one set of sides of the cylinders of the clamping means.

5. Apparatus as claimed in claim 1, in which the fluid pressure medium comprises water and in which the first supply duct is part of a subsystem whose fluid pressure medium is partly water and partly a liquid with a lower specific gravity than water.

6. Apparatus as claimed in claim 5, in which the said liquid is oil.

* * * * *